United States Patent [19]

Teshima et al.

[11] 4,274,804

[45] Jun. 23, 1981

[54] AXIAL-FLOW TURBINE

[75] Inventors: Kiyomi Teshima; Toshio Tsuboi; Yukimasa Kajitani, all of Tamano, Japan

[73] Assignee: Mitsui Engineering and Shipbuilding Co., Ltd., Tokyo, Japan

[21] Appl. No.: 75,595

[22] Filed: Sep. 14, 1979

Related U.S. Application Data

[63] Continuation-in-part of Ser. No. 918,463, Jun. 23, 1978, abandoned.

[30] Foreign Application Priority Data

Jul. 15, 1977 [JP] Japan ..... 52-85314

[51] Int. Cl.[3] ..... F01D 25/32

[52] U.S. Cl. ..... 415/121 A; 415/199.5

[58] Field of Search ..... 415/199.5, 213 C, 121 A, 415/121 R

[56] References Cited

U.S. PATENT DOCUMENTS

| | | | |
|---|---|---|---|
| 1,696,002 | 12/1928 | Hanzlik | 415/121 A |
| 3,066,912 | 12/1962 | Scheper, Jr. | 415/121 A |
| 3,724,967 | 4/1973 | Fischer | 415/121 A |

FOREIGN PATENT DOCUMENTS

| | | | |
|---|---|---|---|
| 836987 | 4/1952 | Fed. Rep. of Germany | 415/199.5 |
| 1428136 | 9/1969 | Fed. Rep. of Germany | 415/199.5 |
| 322810 | 12/1929 | United Kingdom . | |
| 323078 | 12/1929 | United Kingdom . | |
| 343407 | 5/1930 | United Kingdom . | |
| 1310593 | 3/1973 | United Kingdom . | |

*Primary Examiner*—Leonard E. Smith

*Attorney, Agent, or Firm*—Armstrong, Nikaido, Marmelstein & Kubovcik

[57] ABSTRACT

An axial-flow turbine which is driven by a working fluid which contains dust and moisture is disclosed. The turbine has stator blade means and rotor blade means, and a working fluid exit angle of a first-stage stator blade means is smaller than that of the second-stage stator blade, wherein the absolute exit velocity of the working fluid from the first stage stator blade means is smaller than that of the second stage stator blade means, whereby the flow of the working fluid has the same directional vortical flow with the turbine shaft as the axis of the vortex and dust fouling is checked particularly in connection with the first-stage stator blade means.

12 Claims, 5 Drawing Figures

AXIAL-FLOW TURBINE

This application is a continuation-in-part of application Ser. No. 918,463 filed June 23, 1978, now abandoned.

BACKGROUND OF THE INVENTION (1) Field of the Invention

The present invention relates to the field of axial-flow turbines and, more particularly, those of the type in which a gas containing dust and mist such as blast-furnace gas is utilized as the working fluid, and it contemplates to provide an improved axial-flow turbine, in which fouling with the dust contained in the gas can be effectively prevented and which can be operated at a high efficiency.

(2) Description of the Prior Art

Furnace gas has a high pressure value as well as a high temperature. In addition, it is generated in great volumes, and to discharge it into air as it is emitted from the furnace directly means loss of great amounts of energy. Thus, it has been proposed to recover the high pressure energy possessed by furnace gas, as for example in the U.S. Pat. No. 3,818,707 to Boundard et al. This patent proposes, as a means for removing dust from the furnace gas, to charge the gas into a wet-type gas cleansing device or venturi scrubber, in which the gas is washed to reduce the dust content, and then feed the gas into the turbine.

For a power or energy recovery apparatus of this type, centrifugal turbines are generally employed: Centrifugal turbine have fundamental structural features such that they hardly permit dust clogging to occur, have a relatively high resistivity against impurities in gas such as dust, and allow the dust to be discharged with relative ease.

However, the energy recovery apparatus relied on a centrifugal turbine has to be relatively great in size and expensive to install; in addition, the efficiency of the turbine itself is relatively low and rate of energy recovery cannot be disirably high.

In comparison to centrifugal turbines, axial-flow turbines have an essentially desirable characteristic such that they can be smaller in size and yet have a higher efficiency. However, the axial-flow turbine, too, have certain difficulties. For example, they permit dust to attach to their blades with relative ease, whereby it rather easily tends to occur that their efficiency is lowered, that the flow rate of gas is affected when the nozzles are clogged, if partly, with the dust, or that abnormal vibration is generated due to dust accumulation on the rotor blades. Dust attached to blades undergoes agglomeration, and when the dust agglomerate has grown to a certain size, it suddenly becomes liberated from the blade surface and sent into the succeeding stage or stages, whereby it is likely to impair or break fixed blade or mobile blade driven at a high speed.

In U.S. Pat. No. 3,818,707 above referred to, the saturation degree of the furnace gas to be charged into the turbine is enhanced by way of having the moisture in the gas evaporated, and while maintaining the saturation of gas at least at the same as the elevated degree, gas is expanded in the turbine. However, to adjust the degree of saturation of gas as prescribed not only requires a highly attentive care to exert but also make it extremely difficult in case of failure to effect an exact adjustment to check the attachment of dust in the turbine.

The manner in which dust becomes attached to the mobile blades and so forth can vary depending on a difference in the amount of dust in the gas, flow rate of gas and so forth. For example, in the instance of a blast furnace, the exhaust gas that has been treated through a venturi scrubber, a wet-type dust removing device, normally contains dust in an amount on the order of 100 $mg/Nm^3$ and moisture 3–5 $g/Nm^3$. Such gas very easily tends to attach about wall surfaces of its path in a turbine, particularly the surfaces of nozzles or fixed blades of an upstream stage or stages.

In order to prevent such dust attachment or dust fouling from occurring, the present inventors have attempted to jet water onto portions of the furnace which easily permit dust fouling to take place, but good results were not obtained.

In this connection, there also has been a proposed method, according to which before it is blasted into the turbine, a gas which has been suitably cleansed is subjected to a heat application to completely dry it. However, to put such a method into operation indispensably requires a particular device for partly burning the furnace gas or a heat exchanger, whereby not only is the cost of installation increased but also the operating conditions become more complicated.

BRIEF SUMMARY OF THE INVENTION

Through a careful analytic considration of the current state of the art as briefly recited above, the present inventors have determined that merely by applying the existing axial-flow turbine to an energy recovery system, it is difficult to prevent dust fouling and the danger of breaking the turbine by collision of agglomerates of dust against its various members, and the present invention has resulted from a study directed to attain an improvement in relation to the axial-flow turbine itself.

Various data in the art clearly tell that when the load on nozzles or stator blades is greater, the phonomenon of dust fouling on nozzles is more likely to occur. With axial-flow turbines generally in use today, in order to economize the cost price involved an effort is made to increase the load per stage of nozzles and reduce the number of nozzle stages to thereby minimize the entire turbine structure in size. The technical concept on which the present invention is based entirely different from or rather contrary to such concept of the prior art.

The object of the present invention is to provide an improved axial-flow turbine in the system for recovering energy possessed by an industrial exhaust gas, for example furnace gas, having a high pressure as well as high temperature in invevitably containing dust and mist, which turbine has a structure capable of checking dust fouling on the fixed blades or nozzles and the rotor blades as well.

In accordance with the present invention, these obejcts can be attained by an axial-flow turbine operable with a working fluid containing dust and moisture, comprising a turbine casing, a turbine shaft rotatably supported in a central portion thereof, stator blade means mounted within the turbine casing, rotor blade means mounted about the outer periphery of the turbine shaft, said stator and rotor blade means being alternately disposed in the direction of the turbine shaft in mutually opposing arrangement with respect to the angle of their disposition relative to the turbine shaft and having a turbine blade shape in cross-section, characterized in that an exit angle of a first-stage stator blade means with respect to the flow of the working fluid is less than 60° which is smaller than an exit angle of a second-stage stator blade means, and the height of the first-stage stator blade means is 0.8–1.0 times as large as the height of the second-stage stator blade means, wherein the absolute exit velocity of the working fluid from the first-stage stator blade means is below 200 m/s which is smaller than the absolute exit velocity of the second-stage stator blade means, whereby the absolute exit velocity of the working fluid from each stator and rotor blade means includes a directionally same velocity component with respect to the turbine shaft axis, and the flow of the working fluid has the same directional vortical flow with the turbine shaft as the axis of the vortex.

As before indicated, dust attachment on the stator blade surface is closely related with the load on the blades, and under greater load conditions, the greater are the amounts of attached dust. The present invention makes use of the knowledge or observation of such phenomenon, and it has as its first characteristic feature that in the axial-flow turbine of the invention the nozzle load or stator blade load at the first blade stage is reduced in comparison to that in the case of the existing turbines. That is, in conventional turbines loads on stator blades at all stages are substantially the same, but in the axial-flow turbine according to the present invention the load on the first-stage stator blade is smaller than the stator blade load at the succeeding stage or stages. To this reduce the stator blade load at the first stage in comparison to the load at a second stage, the absolute exit velocity and exit angle of the working fluid may be made smaller in connection with the first-stage stator blade means than with the second-stage stator blade means. The above also means to have the flow area relatively increased at the first stage.

Thus, according to the present invention, although such turbines in which the height of the first-stage stator blade is smaller than that of the second-stage stator blade are included in the scope thereof, the difference in height between the first-stage and the second-stage stator blade means is relatively small in comparison to the difference in conventional turbines and essentially the stator blade means are virtually same great in height at the first stage and at the second stage.

A second characteristic of the turbine in accord with the present invention consistis in that the dust contained in the working fluid delivered into the turbine is captured and discharged out of the turbine by assistance of moisture, whereby the concentration of dust in the working fluid is effectively lowered and dust fouling is prevented from occurring. To this end, relatively large stator and rotor blade means are employed at the first stage. With the rotor blade means, they may be same large as or appreciably larger than the stator blade means at the corresponding stages.

A further characteristic of the present invention resides in that in order to have the dust captured at a high efficiency, it is devised to let the gas (working fluid) flow in the turbine while it is turned or revolved and have the dust be forced against the inner wall surface of the turbine casing due to the centrifugal force generated in the gas or gas flow.

DETAILED DESCRIPTION OF THE PREFERRED EMBODIMENT

Figure 1:
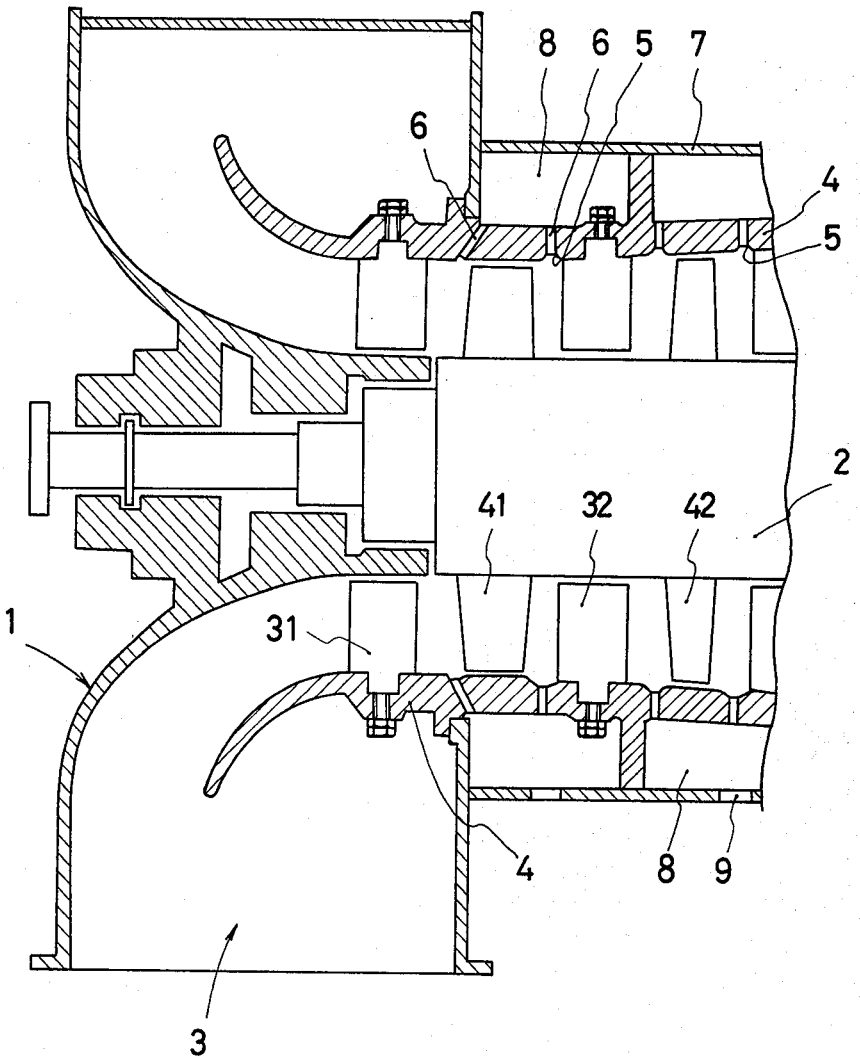
FIG. 1 is a fragmentary sectional view, showing a first few stage portions, including the rotor shaft, of the improved axial-flow turbine in accordance with the present invention.

The load on nozzles or stator blades is represented by the "temperature lowering coefficient" (H), which is shown by the rate of the temperature lowering value converted to a velocity value ($2gJC_p\Delta T$) to the square of the circumferential velocity of rotor blades ($U^2$), namely, $$H=(2gJC_p\Delta T)/U^2$$

wherein g = acceleration of gravity;

J = mechanical equivalent of heat;

$C_p$ = specific heat at constant pressure; and $\Delta T$ = temperature lowering through stages.

With the turbines of general use today, the selected range of this value H at the first stage is from 2.0 to 4.0. With turbines having a temperature lowering coefficient within such range, the exit velocity and angle of the gas flowing out of nozzles at the first stage are respectively above 300 m/s and above 60°.

According to a number of experiments conducted by the present inventors, it has been observed that when the exit velocity of gas from nozzles at the first stage is reduced to a value on the order of 200 m/s, the dust attachment or fouling tends to be suppressed, which can be further remarkably suppressed at an exit velocity below 150 m/s. Further, the temperature lowering coefficient at the gas exit velocity of 150 m/s is within a range of from 0.5 to 1.0 and the exit angle of gas is then on the order of 50°.

In the present invention, the flow of gas in the turbine is regulated in accordance with the observation made as above and, more specifically, the exit velocity of gas from nozzles or fixed blades at least at the first or primary stage is restricted to below 200 m/s. By thus controlling the flow of gas in the turbine and, more particularly, the exit velocity and exit angle of gas, the absolute velocity of exit of gas from fixed blades or nozzles and that of mobile or rotor blades receiving gas flow from the fixed blades can be directed in the same direction of revolution or whirling with respect to the turbine shaft, whereby the flow of gas exerts a centrifugal force, which functions to separate dust from the gas and force the dust against the inner wall surface of the turbine casing to be eventually guided into and captured in dust capturing groove provided peripherally about the inner wall of the turbine casing.

Referring now to the accompanying drawings and FIG. 1 thereof, the axial-flow turbine according to the present invention therein illustrated includes a turbine casing 1 and, in a central portion thereof, a rotatably supported rotor turbine shaft 2. The casing 1 has a gas inlet opening 3 provided thereto, and within its portion 4 of the casing 1 surrounding the rotor turbine shaft 2 there are provided first-stage nozzles or stator blades 31, second-stage nozzles or stator blades 32, and so on.

Further, about the outer periphery of the rotor turbine shaft 2, the first-stage rotor blades 41, second-stage rotor blades 42 and so on are successively mounted.

The stator blades 31, 32 and the rotor blades 41, 42 are disposed alternately in the direction of the turbine shaft 2 and in mutually opposing arrangement with respect to the angle of their disposition relative to the turbine shaft 2. The stator and rotor blades have a turbine blade shape in cross-section.

With an axial flow turbine utilizing a working fluid containing moisture and dust, required are considerations different from those required with other ordinary gas turbines. This is because in cases of such axial-flow turbines there tend to occur wearing of blades due to dust and moisture (the so-called erosion) and an attachment and agglomeration of dust through the flow passage and particularly at stator blades and the gas inlet portion of the turbine where relatively great is flow turbulence.

To have such difficulties effectively cancelled in the case of axial-flow turbines under consideration, various means may be proposed such as follows:

(a) To increase the moisture content in the working fluid and utilize the moisture for scouring the fluid;

(b) to make blades relatively large in size to accordingly increase the passage area of the working fluid, and prolong the time for dust agglomerates attached to blades to form bridge between blades;

(c) to decelerate the flow velocity of the working fluid; and (d) to decelerate the flow velocity and reduce the flow angle of the working fluid so as to have the work per stage suppressed (this means an increase in the number of stages in comparison to the case of an ordinary gas turbine of the corresponding pressure level), and reduce the load at the first stage, while loads at the succeeding stages being of a same level as in ordinary gas turbines.

Figure 2:
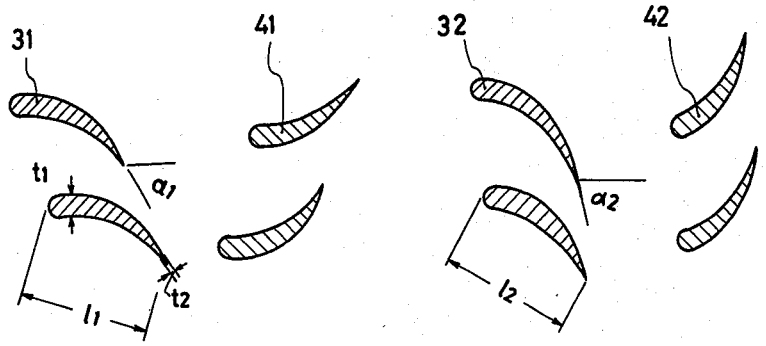
FIG. 2 is a sectional view, taken for explanation of blade means.
Figure 3:
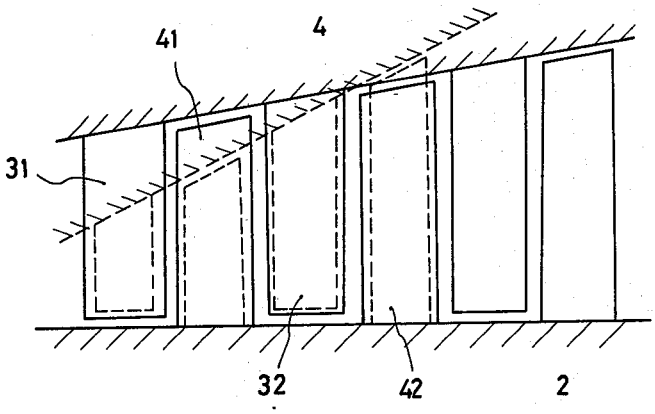
FIG. 3 shows a side elevational view of an essential portion, taken for explanation of blades.

In view of the above considerations, it is preferably made in the axial-flow turbine according to the present invention that blade means have below mentioned particulars relative to their configuration and size (FIGS. 2 and 3).

First, the exit angle of the working fluid at the first-stage stator blade 31 is shown by the angle taken between the rear face at the trailing end of the blade 31 and the axis of the turbine shaft (exit angle $\alpha_1$), which may be within a range of 45°–60° and, more preferably, 48°–55°. The exit angle $\alpha_2$ at the second-stage stator blade 32 may be within a range above 60° and normally up to 75°.

Then, blades at the first stage may be greater in size than the corresponding blades in ordinary gas turbines. In the illustration in FIG. 3, the solid line represents the present invention, the dotted line representing an ordinary gas turbine. As shown, the first-stage stator blade is in height the same as or only slightly smaller than the second-stage stator blade. That is to say, the height of the first-stage blade may be about 0.8 to 1.0 times the height of the second-stage blade. More practically, the height of the first-stage stator blade may be for example 200–300 mm, and that of the second-stage stator blade may be 250–350 mm.

In the illustration in FIG. 2, the blade chord length of the first-stage stator blade, $l_1$, may be 200–300 mm and the corresponding length of the second-stage stator blade, $l_2$, may be 150–250 mm, wherein the chord length $l_1$ may preferably be 1.5 to 2.0 times as great as the chord length $l_2$. Further, with the first-stage stator blade, the ratio of the blade height to the chord length $l_1$ may preferably be about 0.5 to 1.5. Similarly, the corresponding ratio with the second-stage stator blade may be about 1.0 to 2.0. Also, the maximum thickness portion in cross-section of the first-stage stator blade, $t_1$, can be 30–45 mm.

Then, with configurations of rotor blades, they may be virtually the same as those of stator blades at the corresponding stages, but in size rotor blades may be somewhat greater than the stator blades. Further, the thickness $t_2$ at the trailing edge of the first-stage stator blade may preferably be more or less thick so as to be within a range of 6 to 12 mm, and this is for enhancing the anti-erosion characteristic.

Figure 4:
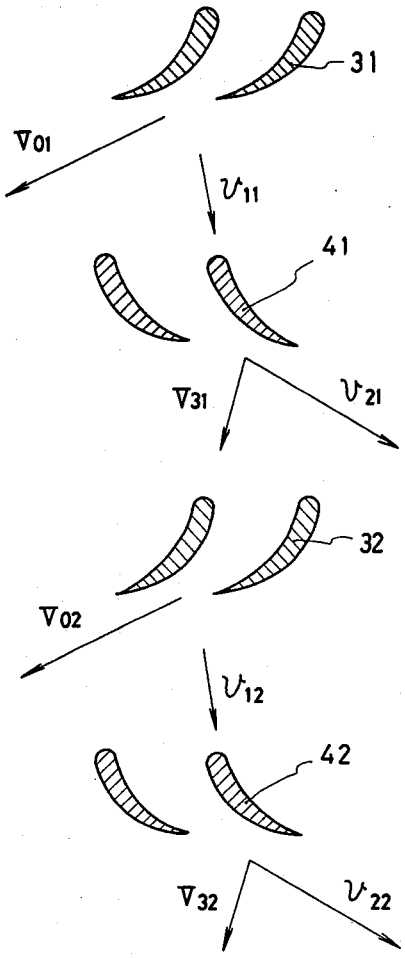
FIG. 4 illustrates a sectional view of blades, taken for a schematic illustration of the flow of gas.

Now, entering an explanation on the flow of gas with reference to FIG. 4, $Vo_1$ and $Vo_2$ in the figure represent the absolute exit velocity relative to the first-stage and second-state stator blades 31 and 32, respectively, $v_{11}$ and $v_{12}$ being respectively the relative velocity thereof to the first and second stage rotor blades 41 and 42.

Similarly, $V_{31}$ and $V_{32}$ respectively denote the absolute exit velocity of the gas from the first and second stage rotor blades 41 and 42, and $v_{21}$ and $v_{22}$ are respectively the relative velocity thereof.

Figure 5:
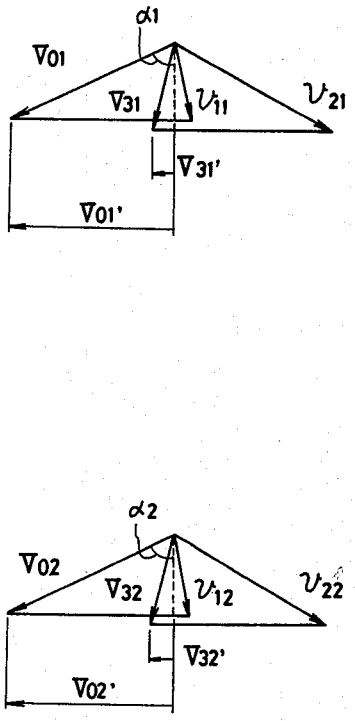
FIG. 5 shows velocity diagrams.

Shown in FIG. 5 are velocity triangles of each velocity component of the flow of gas in the turbine illustrated in FIG. 4. As shown in FIG. 5, according to the present invention the components $Vo_{1'}$, $Vo_{2'}$, $V_{31'}$ and $V_{32'}$ respectively of the absolute exit velocities $Vo_1$, $Vo_2$, $V_{31}$ and $V_{32}$ of the gas flow from fixed blades or nozzles 31, 32 and rotor blades 41, 42 are directed in an identical direction with respect to the axis of the rotor shaft. That is to say, it is proposed in accordance with the present invention that the absolute exit velocity of the gas flowing from stator blades and that of the gas flow from rotor blades are made including a same directional component of velocity relative to the axial direction of the turbine shaft so that the flow of gas in the turbine can have a radial or whirling component with the turbine shaft as the axis of whirling or turning. By way of a further and general explanation of this concept of the present invention, in the turbine pursuant to the present invention a gas is caused to flow a helical path with the turbine shaft as the center of the helicoid, toward the discharge end of the turbine.

Thus, according to the present invention, it may be made that the absolute exit velocity and the exit angle is relatively small at the first stage with those at the succeeding stages made relatively great to provide varied blade load conditions from the first stage to the last blade stage such as, for example, 20% at the first stage, 35% at the second stage and 45% at the third stage. According to the present invention, further, although it can be made that while it is relatively small at the first stage, the blade load is of a constant value at the succeeding stages, it is preferred in view of balancing to make the blade load increasingly greater as the stage is higher.

To have the gas flow regulated or controlled in a manner as stated above, which has a great improtance in the present invention, means to thereby impart a centrifugal force to the gas or the gas flow itself, whereby impurities contained in the gas having a greater weight than gas, such as dust and water drops, can be forced to collect about the inner wall surface of the casing 4.

As shown in FIG. 1, the casing 4 has about its inner wall surface peripheral dust capturing grooves 5, which preferably are provided between each adjacent fixed blade and mobile blade and at positions not likely to influence the turbine characteristics. Each groove 5 has a discharge opening 6 at its bottom, which is in communication with a separation chamber 8 formed between the casing 4 and a covering 7 externally surrounding the same; alternative to such structure comprising groove 5 and opening 6, slits having the function of both groove 5 and opening 6 may be provided.

The separation chamber 8 is communicated with a suitable discharge piping (not shown), and the dust collected or captured in the peripheral groove 5 enters the separation chamber 8 through the opening 6 and, together with the moisture similarly collected, accumulates in the form of water drops on the bottom portion of the chamber 8 to be discharged out of the turbine either directly through a drain hole 9 or further through the above-mentioned discharge piping (not shown) via the hole 9.

According to the characteristic construction of the present invention previously pointed out, gas flowing in the turbine, per se, is imparted with a component of swirling with the turbine shaft as its axis, and through utilization of the centrifugal force generated due to such swirling component of the motion of the gas flow, dust in the gas is forced against the inner wall surface of the turbine casing and collected in the groove or slit provided peripherally about the same inner wall surface, the collected dust being discharged out of the turbine together with any moisture in the gas captured alike the dust.

With the axial-flow turbines generally in use today, of which the structure is not such as being capable of generating a whirling component in the flow of gas, the exit velocity of the gas from stator blades at the first stage exceeds 300 m/s and the exit angle relative to the same blades is above 60°. In turbines of such structure, the direction of the velocity components $Vo_{1'}$ and $Vo_{2'}$ and that of the components $V_{31'}$ and $V_{32'}$ are opposite to each other, whereby the gas flow is permitted to meander in its path of flow and the gas is therefore permitted to flow through the succeding blade stages in its condition containing dust therein, whereby it tends to result in that the dust becomes attached onto and accumulated on the surface of the blades, particularly the stator blades, and that the flow of gas is seriously suppressed or the rotor blades driven at a high velocity are damaged by agglomerates of dust liberated from the blade surface and colliding against the blades.

In the turbine of the present invention, the exit velocity and angle of gas from the first stages nozzles are restricted to below 200 m/s and, more preferably, 140–180 m/s, for instance 150 m/s, and on the order of 50°, respectively, whereby gas can flow along a spiral path in the turbine as before stated and the impurities in gas such as dust and mist can be positively removed from the gas.

Further, according to the present invention, dust is collected on the inner wall surface of the casing, and as so concentrated, is guided into grooves or slits peripherally provided about the casing inner wall to be eventually discharged out of the turbine. Accordingly, the dust originally contained in the gas can be reduced together with any moisture in the gas, successively as the gas flows in the turbine toward the discharge end thereof, so that the nozzles cannot easily be fouled with dust, and even if a dust fouling should occur, it will not be of an appreciable degree, not seriously affecting the operation efficiency of the turbine or causing damage to rotor blades.

Thus, pursuant to the characteristic concept of the present invention, it is feasible to operate an axial-flow turbine using as the working fluid a dust-containing gas such as blast furnace gas in particular, and recover the energy possessed by such gas with safety.

As before stated, in the present invention the exit velocity and angle of gas are particularly defined in the direction of reducing the load on the stator blades. However, today commercially unavailable is an axial-flow turbine satisfactory in this respect, and it is therefore required to modify the configuration and so forth of stator blades and rotor blades, in connection with the existing axial-flow turbines. However, such requirement can well be compensated for by the merit such that the energy or power of an exhaust gas that has heretofore been simply discarded can be effectively recovered and yet with safety.

Particularly, the blast-furnace gas normally contains a relatively great amount of dust, and if treated through a wet-type dust remover, it still remains to contain dust therein. According to the present invention, however, the axial-flow turbine itself is possessed of a function to essentially separate away the dust from the gas, and the present invention can attain another advantage that the operation and control of the dust remover device is therefore greatly simplified.

What is claimed is:

1. An improved axial-flow turbine operable with a working fluid containing dust and moisture, comprising a turbine casing, a turbine shaft rotatably supported in a central portion thereof, stator blade means mounted within the turbine casing, and rotor blade means mounted about the outer periphery of the turbine shaft, said stator and rotor blade means being alternately disposed in the direction of the turbine shaft, in mutually opposing arrangement with respect to the angle of their disposition relative to the turbine shaft and having a turbine blade shape in cross-section, characterized in that an exit angle of a first-stage stator blade means with respect to the flow of the working fluid is less than 60° which is smaller than an exit angle of a second-stage stator blade means, and the height of the first-stage stator blade means is 0.8–1.0 times as large as the height of the second stage stator blade means, wherein the absolute exit velocity of the working fluid from the first-stage stator blade means is below 200 m/s which is smaller than the absolute exit velocity of the second-stage stator blade means, whereby the absolute exit velocity of the working fluid from each stator and rotor blade means includes a directionally same velocity component with respect to the turbine shaft axis, and the flow of the working fluid has the same directional vortical flow with the turbine shaft as the axis of the vortex.

2. An improved axial-flow turbine according to claim 1, wherein the exit angle of the first-stage stator blade means is within a range of from less than 60° to 45°, and the exit angle of the second-stage stator blade means is within a range of from 60° to 75°.

3. An improved axial-flow turbine according to claim 1, wherein the blade chord lengths of the first-stage stator blade means is 1.0–2.0 times as large as the blade chord length of the second-stage stator blade means.

4. An improved axial-flow turbine according to claim 1, wherein the blade chord lengths of the first-stage stator and rotor blade means are 200–300 mm.

5. An improved axial-flow turbine according to claim 1, wherein the ratios of the height to the blade chord length in the first-stage stator blade means is adjusted to 0.5–1.5.

6. An improved axial-flow turbine according to claim 1, wherein the height of the first-stage stator and rotor blade means are 200–300 mm.

7. An improved axial-flow turbine according to claim 1, wherein the ratio of the height to the blade chord length in the second-stage stator blade means is adjusted to 1.5 to 2.0.

8. An improved axial-flow turbine according to claim 1, wherein the thickness of the trailing edge in the first-stage stator blade means is 6 to 12 mm.

9. An improved axial-flow turbine according to claim 1, wherein the height of the second-stage stator and rotor blade means are 0.8–1.0 times as large as the height of a third-stage stator and rotor blade means, respectively.

10. An improved axial-flow turbine according to claim 1, further comprising a dust capturing groove or slit provided along the inner wall surface of the turbine casing between each adjacent stator blade means and rotor blade means.

11. An improved axial-flow turbine according to claim 10, further comprising a separation chamber formed between the turbine casing and an outer covering surrounding the former with a space therebetween, said separation chamber being communicated with the dust capturing groove or slit.

12. An improved axial-flow turbine according to claim 10, wherein the dust capturing groove or slit is provided peripherally about the inner wall surface of the turbine casing.

* * * * *